US011560639B2

(12) United States Patent
Chen et al.

(10) Patent No.: US 11,560,639 B2
(45) Date of Patent: Jan. 24, 2023

(54) NANO-TWINNED COPPER LAYER WITH DOPED METAL ELEMENT, SUBSTRATE COMPRISING THE SAME AND METHOD FOR PREPARING THE SAME

(71) Applicant: NATIONAL YANG MING CHIAO TUNG UNIVERSITY, Hsinchu (TW)

(72) Inventors: Chih Chen, Hsinchu (TW); Kang-Ping Lee, Hsinchu (TW)

(73) Assignee: NATIONAL YANG MING CHIAO TUNG UNIVERSITY, Hsinchu (TW)

( * ) Notice: Subject to any disclaimer, the term of this patent is extended or adjusted under 35 U.S.C. 154(b) by 0 days.

(21) Appl. No.: 17/321,717

(22) Filed: May 17, 2021

(65) Prior Publication Data

US 2022/0282389 A1 Sep. 8, 2022

(30) Foreign Application Priority Data

Mar. 5, 2021 (TW) ..... 11010795.3

(51) Int. Cl.
*C25D 3/38* (2006.01)
*C25D 3/46* (2006.01)
*C25D 7/12* (2006.01)

(52) U.S. Cl.
CPC ..... *C25D 3/38* (2013.01); *C25D 3/46* (2013.01); *C25D 7/12* (2013.01)

(58) Field of Classification Search
None
See application file for complete search history.

(56) References Cited

U.S. PATENT DOCUMENTS

2013/0122326 A1* 5/2013 Chen ..... C25D 5/08 205/291

OTHER PUBLICATIONS

Zhang et al. (Scripta Materialia 129 '2017' 39-43). (Year: 2017).*

* cited by examiner

*Primary Examiner* — Wojciech Haske
(74) *Attorney, Agent, or Firm* — Muncy, Geissler, Olds & Lowe, P.C.

(57) ABSTRACT

A nano-twinned copper layer with a doped metal element is disclosed, wherein the nano-twinned copper is doped with at least one metal element selected from the group consisting of Ag, Ni, Al, Au, Pt, Mg, Ti, Zn, Pd, Mn and Cd in a region from a surface of the nano-twinned copper layer to a depth being 0.3 μm, and a content of the metal element in the region is ranged from 0.5 at % to 20 at %. In addition, at least 50% in volume of the nano-twinned copper layer includes plural twinned grains. Furthermore, a substrate including the aforesaid nano-twinned copper layer and a method for preparing the aforesaid nano-twinned copper layer are also disclosed.

19 Claims, 6 Drawing Sheets

NANO-TWINNED COPPER LAYER WITH DOPED METAL ELEMENT, SUBSTRATE COMPRISING THE SAME AND METHOD FOR PREPARING THE SAME

CROSS REFERENCE TO RELATED APPLICATION

This application claims the benefits of the Taiwan Patent Application Serial Number 110107953, filed on Mar. 5, 2021, the subject matter of which is incorporated herein by reference.

BACKGROUND OF THE INVENTION

1. Field of the Invention

The present disclosure relates to a nano-twinned copper layer with a doped metal element, a substrate comprising the same and a method for preparing the same. More specifically, the present disclosure relates to a nano-twinned copper layer with a doped metal element having high hardness, a substrate comprising the same and a method for preparing the same.

2. Description of Related Art

Conventionally, the mechanical property of copper can be enhanced by rolling or doping with other metal such as Ti, Ni or Zn, but the conventional method still has its disadvantage.

If the copper film comprising copper grains is enhanced by rolling, the pure copper grains may be deformed. Even though the mechanical property of the copper film can be enhanced by rolling, the resistance thereof may be increased and the thermal conductivity thereof may be decreased. In addition, the copper film doped with other metal may cause the resistance of the copper film increased, thereby reducing the electrical conductivity. Furthermore, the nano-twinned copper film has high strength. If the strength of the nano-twinned copper film is enhanced by grain refining, the obtained nano-twinned copper film may have the problem of poor thermal stability.

Therefore, it is desirable to provide a novel nano-twinned copper layer, wherein the strength thereof can be increased and the property thereof can be maintained, so that this nano-twinned copper layer can be applied to various electronic device.

SUMMARY OF THE INVENTION

An object of the present disclosure is to provide a nano-twinned copper layer with a doped metal element, which has high hardness.

In the nano-twinned copper layer with a doped metal element, the nano-twinned copper is doped with at least one metal element selected from the group consisting of Ag, Ni, Al, Au, Pt, Mg, Ti, Zn, Pd, Mn and Cd in a region from a surface of the nano-twinned copper layer to a depth being 0.3 μm, and a content of the metal element in the region is ranged from 0.5 at % to 20 at %; wherein at least 50% in volume of the nano-twinned copper layer comprises plural twinned grains.

In addition, the present disclosure further provides a substrate having the aforesaid nano-twinned copper layer, which comprises: a substrate; and the aforesaid nano-twinned copper layer disposed on the substrate or embedded into the substrate.

Furthermore, the present disclosure further provides a method for preparing the aforesaid nano-twinned copper layer with the doped metal element, which comprises the following steps: providing a nano-twinned copper layer, wherein at least 50% in volume of the nano-twinned copper layer comprises plural twinned grains; forming a metal film on a surface of the nano-twinned copper layer, wherein the metal film comprises at least one metal element selected from the group consisting of Ag, Ni, Al, Au, Pt, Mg, Ti, Zn, Pd, Mn and Cd; and annealing the nano-twinned copper layer provided with the metal film at 50° C. to 250° C. to form a nano-twinned copper layer with a doped metal element, wherein the nano-twinned copper layer is doped with the metal element in a region from a surface of the nano-twinned copper layer to a depth being 0.3 μm, and a content of the metal element in the region is ranged from 0.5 at % to 20 at %.

In the preparation method of the present disclosure, a nano-twinned copper layer with a doped metal element can be simply made by forming a metal film of a specific metal element on the nano-twinned copper layer and annealing it at a low temperature (50° C. to 250° C.) for a period of time. Compared with the conventional nano-twinned copper layer which is not doped with a metal element, the nano-twinned copper layer with the doped metal element prepared by the present disclosure retains the twin-structure of the nano-twinned copper layer without metal element doped and has a hardness which is significantly improved. Therefore, the nano-twinned copper layer with the doped metal element provided by the present disclosure retains the high electrical conductivity and high thermal conductivity of the nano-twinned copper layer. In particular, it has high strength and can be applied to various electronic components.

In the present disclosure, at least 50% in volume of the nano-twinned copper layer may comprise plural twinned grains. In one embodiment of the present disclosure, for example, 50% to 99%, 50% to 95%, 50% to 90%, 55% to 90%, 60% to 90%, or 65% to 95% in volume of the nano-twinned copper layer may comprise plural twinned grains. However, the present disclosure is not limited thereto.

In the present disclosure, the nano-twinned copper layer may be doped with a metal element other than copper in a region from a surface (with a depth of 0 μm) of the nano-twinned copper layer to a depth being 0.3 μm. In other words, in the present disclosure, the nano-twinned copper layer may be doped with the metal element other than copper in the region near the surface of the nano-twinned copper layer. In one embodiment of the present disclosure, the nano-twinned copper layer may be dopped with the metal element other than copper in a region from the surface of the nano-twinned copper layer to the depth being 0.3 μm, 0.2 μn, 0.1 μm or 0.05 μm, but the present disclosure is not limited thereto.

In the present disclosure, the concentration of the metal element gradually decreases from the surface (with a depth of 0 μm) of the nano-twinned copper layer to the depth of 0.3 μm in the region from a surface of the nano-twinned copper layer to the depth being 0.3 μm. In one embodiment of the present disclosure, the metal element other than copper presents a decreasing distribution in the region from the surface of the nano-twinned copper layer to the depth of 0.3 μm, 0.2 μm, 0.1 μm, or 0.05 μm.

In the present disclosure, a content of the metal element in aforesaid region may be ranged from 0.5 at % to 20 at %. In one embodiment of the present disclosure, the content of the metal element in aforesaid region may be ranged from 0.5 at % to 15 at %, 0.5 at % to 10 at %, 0.5 at % to 8 at %, 0.5 at % to 5 at %, 0.5 at % to 3 at %, 0.5 at % to 2 at % or 0.5 at % to 1.5 at %, but the present disclosure is not limited thereto.

In the preparation method of the present disclosure, when the metal film formed on the nano-twinned copper layer is thin or the annealing time is long, all the metal element in the metal film may diffuse to the nano-twinned copper layer, so that the metal film may not be formed on the surface of the nano-twinned copper layer after the annealing. On the contrary, when the metal film formed on the nano-twinned copper metal layer is thick or the annealing time is short, parts of the metal film does not diffuse into the nano-twinned copper layer completely, so that the metal film may be formed on the surface of the nano-twinned copper layer after the annealing. Therefore, in the present disclosure, the nano-twinned copper layer can be optionally provided with a metal film.

In the present disclosure, the metal element of the metal film or the doped metal element may be at least one metal element selected from the group consisting of Ag, Ni, Al, Au, Pt, Mg, Ti, Zn, Pd, Mn and Cd. In one embodiment of the present disclosure, the metal element may be Ag, Ni, Al, Pt, or Zn, but the present disclosure is not limited thereto.

In the present disclosure, the plural twinned grains in the nano-twinned copper layer may be formed by stacking plural nano-twinned grains along a [111] crystal axis. The lamination direction of the nanotwins (i.e., twin direction) is subject to no particular limitation, an angle is included between the lamination direction of the nanotwins and the thickness direction of the nano-twinned copper layer, and the angle is subject to no particular limitation. For example, the angle may be ranged from 0 degree to 60 degrees, 0 degree to 55 degrees, 0 degree to 50 degrees, 0 degree to 45 degrees, 0 degree to 40 degrees, 0 degree to 35 degrees, 0 degree to 30 degrees, 0 degree to 25 degrees or 0 degree to 20 degrees. In addition, in the present disclosure, the nano-twinned grains are not necessarily columnar grains parallel to the thickness direction of the nano-twinned copper layer and may be intersected with the thickness direction of the nano-twinned copper layer at the aforementioned angle. Alternatively, the nano-twinned grains may include the grains having different lamination directions at the same time.

In the present disclosure, at least 50% of an area of the surface of the nano-twinned copper layer may expose a (111) surface of the twinned grains, so the surface of the nano-twinned copper layer has a preferred direction of (111). In one embodiment of the present disclosure, the (111) surface of the nano-twinned grains exposed on the surface of the nano-twinned copper layer may be, for example, 50% to 99%, 55% to 99%, 60% to 99%, 65% to 99%, 70% to 99%, 75% to 99%, 75% to 95% or 75% to 90% of the total area of the surface of the nano-twinned copper layer, but the present disclosure is not limited thereto. Herein, the preferred direction of the surface of the nano-twinned copper layer can be measured by electron backscatter diffraction (EBSD).

In the present disclosure, the twinned grains in the nano-twinned copper layer may be columnar grains stacked along the [111] crystal axis, and may also be non-columnar grains, for example, fine grains. The lamination direction (i.e., twin direction) of the nano-twinned grains of the fine grains is subject to no particular limitation. Furthermore, the nano twins of the fine grains exposed on the surface of the nano-twinned copper layer does not have a preferred direction.

In the present disclosure, whether they are aforesaid columnar grains or fine grains, at least part of the twinned grains may be connected with each other.

In the present disclosure, the thickness of the nano-twinned copper layer may be adjusted according to the need. In one embodiment of the present disclosure, the thickness of the nano-twinned copper layer may be ranged from, for example, 0.1 μm to 500 μm, 0.1 μm to 400 μm, 0.1 μm to 300 μm, 0.1 μm to 200 μm, 0.1 μm to 100 μm, 0.1 μm to 80 μm, 0.1 μm to 50 μm, 1 μm to 50 μm, 2 μm to 50 μm, 3 μm to 50 μm, 4 μm to 50 μm, 5 μm to 50 μm, 5 μm to 40 μm, 5 μm to 35 μm, 5 μm to 30 μm or 5 μm to 25 μm, but the present disclosure is not limited thereto.

In the present disclosure, the diameter of the plural twinned grains may be ranged from 0.1 μm to 50 μm, respectively. In one embodiment of the present disclosure, the diameter of the twinned grains may be ranged from, for example, 0.1 μm to 45 μm, 0.1 μm to 40 μm, 0.1 μm to 35 μm, 0.5 μm to 35 μm, 0.5 μm to 30 μm, 1 μm to 30 μm, 1 μm to 25 μm, 1 μm to 20 μm, 1 μm to 15 μm, or 1 μm to 10 μm, but the present disclosure is not limited thereto. In the present disclosure, the diameters of the twinned grains may be the lengths measured in a direction substantially perpendicular to the twin direction of the twinned grains. More specifically, the diameters of the twinned grains may be the lengths (for example, the maximum length) measured in a direction substantially perpendicular to the lamination direction of the twins or the twin boundaries (i.e., the extension direction of the twin boundary).

In the present disclosure, a thickness of the plural twinned grains may respectively be ranged from 0.1 μm to 500 μm. In one embodiment of the present disclosure, the thickness of the twinned grains may be ranged from, for example, 0.1 μm to 500 μm, 0.1 μm to 400 μm, 0.1 μm to 300 μm, 0.1 μm to 200 μm, 0.1 μm to 100 μm, 0.1 μm to 80 μm, 0.1 μm to 50 μm, 1 μm to 50 μm, 2μm to 50 μm, 3 μm to 50 μm, 4 μm to 50 μm, 5 μm to 50 μm, 5 μm to 40 μm, 5 μm to 35 μm, 5 μm to 30 μm, or 5 μm to 25 μm. In the present disclosure, the thicknesses of the twinned grains may be the thicknesses of the twinned grains measured at the twin direction of the twinned grains. More specifically, the thicknesses of the twinned grains may be the thicknesses (for example, maximum thicknesses) of the twinned grains measured at the lamination direction of the twins or the twin boundaries.

In the present disclosure, "the twin direction of the twinned grain" refers to the lamination direction of the twins or the twin boundaries in the twinned grains. Herein, the twin boundaries of the twinned grains may be substantially perpendicular to the lamination direction of the twins or the twin boundaries. In the present disclosure, the twinned grains are formed by staking plural twins along a [111] crystal axis.

In the present disclosure, the included angle between the twin boundary of the twinned grain and the thickness direction of the nano-twinned copper layer may be measured in a cross-section of the nano-twinned copper layer. Similarly, the features such as the thickness of the nano-twinned copper layer and the diameter or the thickness of the twinned grains may also be measured in a cross-section of the twinned copper layer. Alternatively, the diameter or the thickness of the twinned grains may also be measured from the surface of the nano-twinned copper layer. In the present disclosure, the measurement method is not particularly limited, and may be performed with scanning electron microscope (SEM), transmission electron microscope (TEM), focus ion beam (FIB) or other suitable measurement manners.

In the present disclosure, the metal film may be formed on the nano-twinned copper layer through any method. For instance, the metal film may be formed on the nano-twinned copper layer by vapor deposition or sputtering. In addition, the thickness of the metal film may be ranged from 50 nm to 500 nm, for example, it may be ranged from 50 nm to 450 nm, 50 nm to 400 nm, 50 nm to 350 nm, 50 nm to 300 nm, 70 nm to 300 nm, 70 nm to 250 nm, 80 nm to 250 nm, 80 nm to 200 nm or 80 nm to 150 nm, but the present disclosure is not limited thereto.

In the present disclosure, the nano-twinned copper layer with the metal film is treated with annealing, thereby forming a nano-twinned copper layer with a doped metal element. Herein, the temperature of the annealing may be ranged from 50° C. to 250° C. When the temperature of the annealing is beyond this range, the twin structure in the nano-twinned copper layer may be decreased or disappear. In one embodiment of the present disclosure, the temperature of the annealing may be ranged from 50° C. to 250° C., 50° C. to 200° C., 50° C. to 150° C., 75° C. to 150° C., 75° C. to 125° C. or 100° C. to 125° C., but the present disclosure is not limited thereto. In addition, in the present disclosure, the annealing time is subject to no particular limitation. For example, it may be ranged from 10 minutes to 180 minutes, 30 minutes to 180 minutes, 30 minutes to 150 minutes, 30 minutes to 120 minutes, 50 minutes to 120 minutes, 50 minutes to 90 minutes or 60 minutes to 90 minutes.

In the present disclosure, the preparation method of the nano-twinned copper layer is subject to no particular limitation. For example, the nano-twinned copper layer may be prepared by electrodeposition. In one embodiment of the present disclosure, the nano-twinned copper layer may be prepared by the following steps: providing an electrodeposition device, comprising an anode, a cathode, a plating solution and a power supply, wherein the power supply is respectively connected to the cathode and the anode, and the cathode and the anode are immersed into the plating solution; and performing an electrodeposition process with the electrodeposition device to grow the nano-twinned copper layer on a surface of the cathode.

In the present disclosure, the cathode may be used as a substrate, and the formed nano-twinned copper layer may be provided on the substrate or embedded into the substrate. Herein, the cathode may be a substrate with a metal layer formed thereon or a metal substrate. The substrate may be a silicon substrate, a glass substrate, a quartz substrate, a metal substrate, a plastic substrate, a print circuit board, a III-IV group substrate or a lamination substrate thereof Furthermore, the substrate may have a single-layer or multi-layer structure.

In the present disclosure, the plating solution may comprise a copper salt, a hydrochloric acid, and an acid other than hydrochloric acid. Examples of the copper salt comprised in the plating solution may comprise, but are not limited to, copper sulfate, methyl sulfonic copper or a combination thereof. Examples of the acid comprised in the plating solution may comprise, but are not limited to, sulfuric acid, methane sulfonic acid or a combination thereof. In addition, the plating solution may further comprise an additive, such as gelatin, surfactants, lattice modification agents or a combination thereof.

In the present disclosure, the electrodeposition process may be performed with direct current electrodeposition, high-speed pulse electrodeposition, or direct current electrodeposition and high-speed pulse electrodeposition interchangeably. In one embodiment of the present disclosure, the twinned copper layer is prepared by direct current electrodeposition. The current density used in the direct current electrodeposition may be ranged from, for example, 0.5 ASD to 30 ASD, 1 ASD to 30 ASD, 2 ASD to 30 ASD, 2 ASD to 25 ASD, 3 ASD to 25 ASD, 3 ASD to 20 ASD or 4 ASD to 20 ASD, but the present disclosure is not limited thereto.

The shape of the nano-twinned copper layer provided by the present disclosure is not particularly limited, and may be a foil, a film, a line or a bulk; but the present disclosure is not limited thereto. In addition, the nano-twinned copper layer provided by the present disclosure may have a single layer or a multi-layered structure. Furthermore, the nano-twinned copper layer provided by the present disclosure may be combined with other material to form a multi-layered composite structure.

The nano-twinned copper layer provided by the present disclosure may be applied to various electronic products, for example, a through hole or via of a three-dimensional integrated circuit (3D-IC), a pin through hole of a packaging substrate, a metal interconnect, a substrate circuit or a connector, but the present disclosure is not limited thereto.

Other novel features of the disclosure will become more apparent from the following detailed description when taken in conjunction with the accompanying drawings.

DETAILED DESCRIPTION OF THE PREFERRED EMBODIMENT

Figure 1:
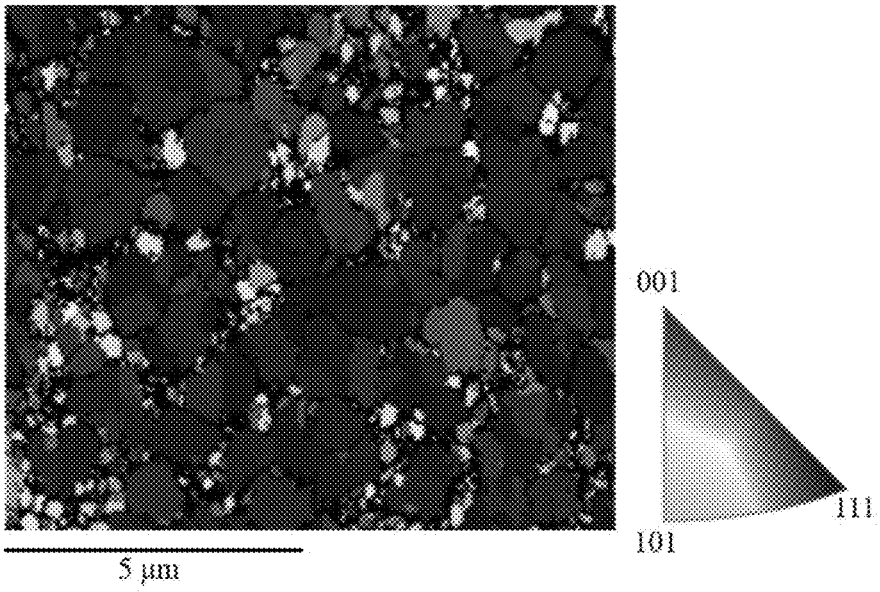
FIG. 1 is an EBSD photo of a non-silver-plated nano-twinned copper layer before annealing according to Embodiment 1 of the present disclosure.

Different embodiments of the present disclosure are provided in the following description. These embodiments are meant to explain the technical content of the present disclosure, but not meant to limit the scope of the present disclosure. A feature described in an embodiment may be applied to other embodiments by suitable modification, substitution, combination, or separation.

It should be noted that, in the present specification, when a component is described to have an element, it means that the component may have one or more of the elements, and it does not mean that the component has only one of the element, except otherwise specified.

In the present specification, except otherwise specified, the feature A "or" or "and/or" the feature B means the existence of the feature A, the existence of the feature B, or the existence of both the features A and B. The feature A "and" the feature B means the existence of both the features A and B. The term "comprise(s)", "comprising", "include(s)", "including", "have", "has" and "having" means "comprise(s)/comprising but is/are/being not limited to".

Moreover, in the present specification, when an element is described to be arranged "on" another element, it does not essentially means that the elements contact the other element, except otherwise specified. Such interpretation is applied to other cases similar to the case of "on".

Moreover, in the present specification, a value may be interpreted to cover a range within ±10% of the value, and in particular, a range within ±5% of the value, except otherwise specified; a range may be interpreted to be composed of a plurality of subranges defined by a smaller endpoint, a smaller quartile, a median, a greater quartile, and a greater endpoint, except otherwise specified.

Embodiment 1

A 12-inch silicon wafer coated with 100 nm Ti/200 nm Cu was broken into 2 cm×3 cm specimens (as a cathode). The specimen was washed with citric acid to remove oxides, and the electrodeposition region was defined with the acid alkaline resistant tape. The area of the total electrodeposition region was 2 cm×2 cm.

The plating solution used in the present embodiment was formulated by $CuSO_4.5H_2O$. The total amount of 196.54 g of $CuSO_4.5H_2O$ (including 50 g/L of copper ion) was provided, added with additive (1.5 ml), and then 100 g of $H_2SO_4$ (96%) was added into the plating solution, followed by adding 0.1 ml of hydrochloric acid (12 N). The plating solution was stirred with a stir bar until $CuSO_4.5H_2O$ was dissolved into the solution (1 L) well, and the rotation speed was 1200 rpm per minute to maintain the homogeneity of the plating solution. The electrodeposition was performed at room temperature, 1 atm. The hydrochloric acid added in the electroplating solution let the copper target (as an anode) dissolve in the electroplating bath normally to balance the concentration of copper ion. Herein, the power supply (Keithley 2400) was controlled by the computer, the electrodeposition was performed with the direct current electrodeposition, and the forward current density was set to 6 ASD ($A/dm^2$). After electroplating for about 20 minutes, a nano-twinned copper layer with a thickness of about 20 μm was obtained.

The obtained specimen was polished by electropolishing, wherein the solution for the electropolishing comprised 100 ml of $H_3PO_4$, 1 ml of acetic acid and 1 ml of glycerol. The specimen to be polished was placed onto the anode, and the electropolishing was performed under 1.75 V for 10 min The specimen after the electropolishing had a thickness of about 19 μm. By electropolishing, it could level the surface of the nano-twinned copper layer, and facilitate the silver ion attaching to the surface of the nano-twinned copper layer in the subsequent vapor deposition process.

The surface preferred direction and the micro-structure of the specimen after the electropolishing was analyzed with electron backscatter diffraction (EBSD) and focus ion beam (FIB), and the hardness of the specimen after the electropolishing was measured with Vickers hardness tester.

Figure 2:
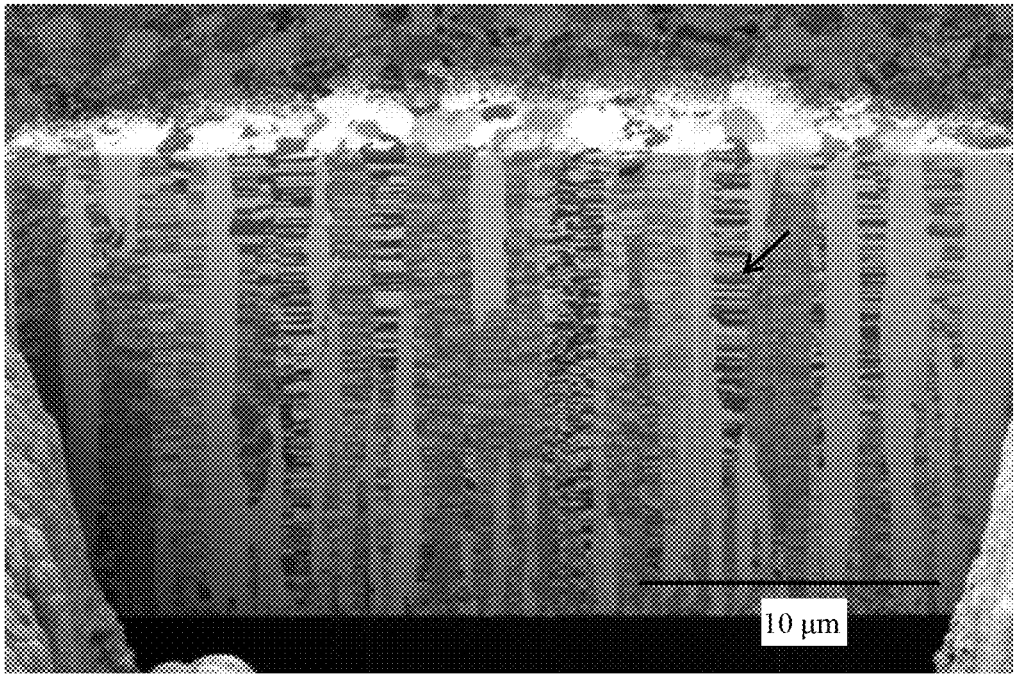
FIG. 2 is a FIB photo of a non-silver-plated nano-twinned copper layer before annealing according to Embodiment 1 of the present disclosure.

FIG. 1 is an EBSD photo of a non-silver-plated nano-twinned copper layer before annealing according to the present embodiment. FIG. 2 is a FIB photo of a non-silver-plated nano-twinned copper layer before annealing according to the present embodiment.

As shown in FIG. 1, the results of the EBSD show that almost all in the volumes (more than 95% of the volume) of the nano-twinned copper layer prepared in the present embodiment are columnar twinned grains being connected with each other, and the diameters of the columnar twinned grains are in a range from about 0.5 μm to 3 μm. In addition, the twinned grains are formed by stacking nano twins along a [111] crystal axis. The twin boundaries of the nano twins are substantially parallel to the cathode surface (i.e. the lamination direction of the nano twins is substantially parallel to the thickness direction of the nano-twinned copper layer), so almost all the surface of the nano-twinned copper layer (more than 95% of the area) expose the (111) surface of the nano twins, which represents the nano-twinned copper layer of the present embodiment has a preferred direction of (111).

As shown in FIG. 2, the result obtained by the FIB measurement indicates that most of the grains in the nano-twinned copper layer are twins with high density. 95% or more in volume of the twinned copper layer comprises twinned grains. The included angles between the twin direction (indicated by the arrow) of 95% or more of the twinned grains and the thickness direction of the nano-twinned copper layer are about 0 degree; the included angles between the twin direction (indicated by the arrow) of 95% or more of the twinned grains and the surface of the substrate are about 90 degrees; and, it indicates that the twin boundaries of the twinned grains are substantially parallel to the surface of the substrate. In addition, 95% or more of the twinned grains in the nano-twinned copper layer have the thickness ranging from about 1 μm to about 20 μm.

Then, the electropolished specimen obtained above was cleaned with a citric acid solution, the water droplets thereon were then removed with a nitrogen gun, and then plated with a silver film using E-beam evaporator. Herein, the thickness of the silver film was 100 nm, the deposition temperature was 85° C., the rate was 1 Å/S, and the time was 25 minutes.

The non-silver-plated specimen and the silver-plated specimen were placed into the furnace to perform the annealing process (heat treatment). The vacuum pressure was $10^{-3}$ torr, the annealing temperature were 100° C., 150° C., 200° C. and 250° C., and the annealing time was 1 hr. The surface preferred direction and the structure of the silver-plated and non-silver-plated specimens after the annealing were analyzed with EBSD and FIB, and the hardness thereof was measured with Vickers hardness tester. The hardness load was 0.005 kg (49.03 mN), and the probe depth was ranged from 750 nm to 1000 nm.

Figure 3:
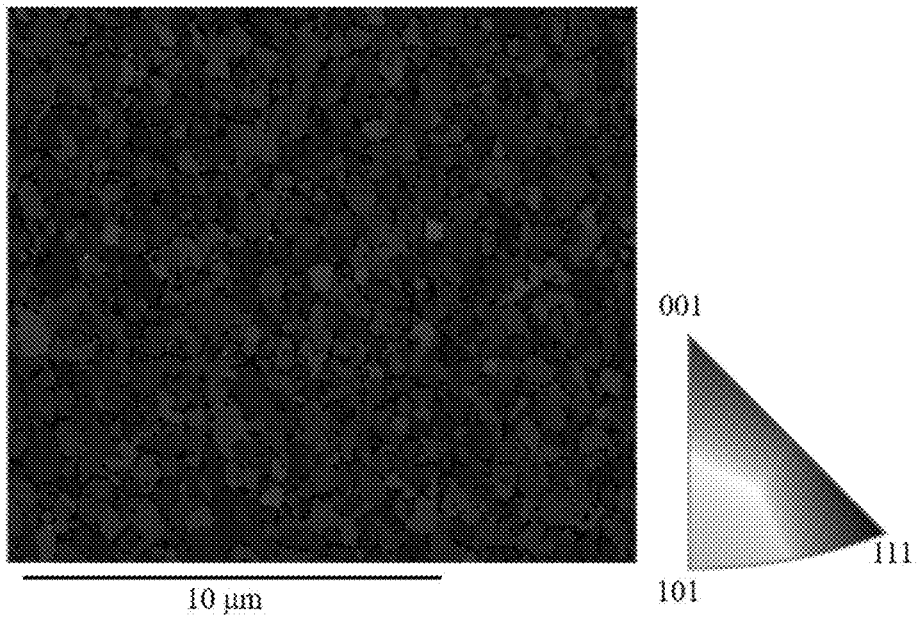
FIG. 3 is an EBSD photo of a silver-plated nano-twinned copper layer after annealing according to Embodiment 1 of the present disclosure.
Figure 4:
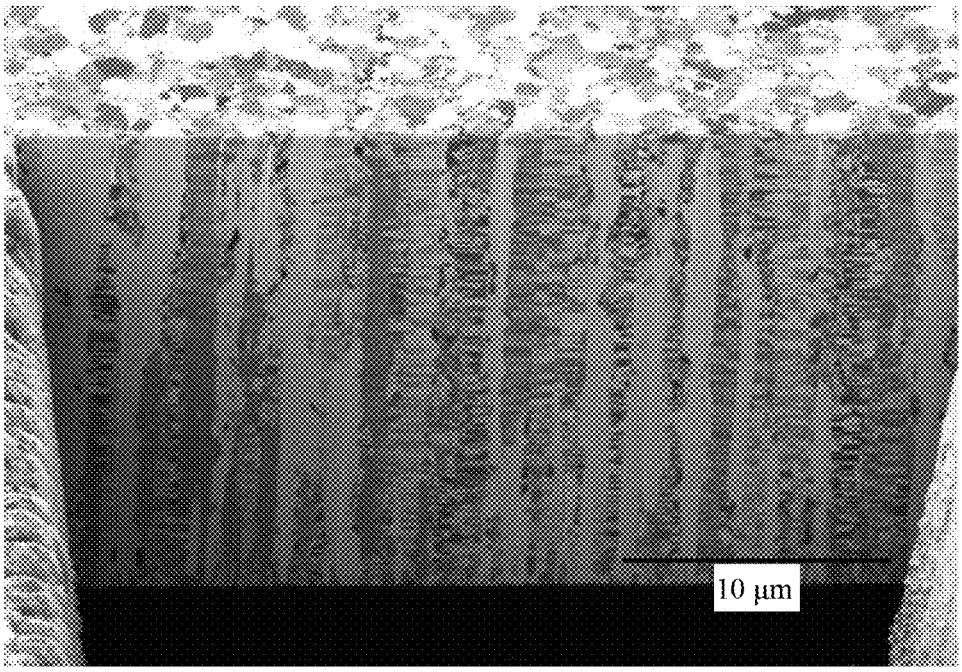
FIG. 4 is a FIB photo of a silver-plated nano-twinned copper layer after annealing according to Embodiment 1 of the present disclosure.

FIG. 3 is an EBSD photo of a silver-plated nano-twinned copper layer after annealing at 100° C. for 1 hr according to the present embodiment. FIG. 4 is a FIB photo of a silver-plated nano-twinned copper layer after annealing at 100° C. for 1 hour according to the present embodiment.

As shown in FIG. 3 and FIG. 4, the silver-plated nano-twinned copper layer of the present embodiment still maintains the structure of the nano-twinned grains similar to that of FIG. 1 and FIG. 2.

In addition, the hardness of the non-silver-plated and the silver-plated specimens obtained before annealing or after annealing at various temperatures for 1 hr are shown in Table 1 below.

TABLE 1

| | Average hardness of the non-silver-plated specimens (HV) | Average hardness of the silver-plated specimens (HV) | Percentage of enhanced hardness (%) |
|---|---|---|---|
| Before annealing | 213.8 ± 8.5 (n = 5) | 217.6 ± 4.9 (n = 5) | 1.8% |
| Annealing at 50° C. for 1 hr | 211.2 ± 2.4 (n = 5) | 221.8 ± 9.0 (n = 5) | 5.0% |
| Annealing at 100° C. for 1 hr | 228.2 ± 5.2 (n = 5) | 270.8 ± 3.6 (n = 5) | 19.0% |
| Annealing at 125° C. for 1 hr | 208.8 ± 4.5 (n = 5) | 238.2 ± 5.6 (n = 5) | 14% |
| Annealing at 150° C. for 1 hr | 192.0 ± 3.7 (n = 5) | 222.6 ± 5.8 (n = 5) | 16% |

As shown in Table 1, compared with the non-silver-plated nano-twinned copper layer, the hardness of the silver-plated nano-twinned copper layer is significantly enhanced regardless of the annealing temperature. In particular, the hardness of the non-silver-plated nano-twinned copper layer is decreased after annealing. However, the hardness of the silver-plated nano-twinned copper layer increases by about 20% after annealing for 1 hr.

In addition, after annealing at 100° C., the hardness of the silver-plated nano-twinned copper layer being annealed is not only higher than that of the non-silver-plated nano-twinned copper layer, but also higher than the silver-plated nano-twinned copper layer being unannealed. As shown in the results listed in Table 1, the hardness of the silver-plated nano-twinned copper layer reaches 270.8 HV after annealing at 100° C. for one hour, and it is increased by 27% compared with the non-silver-plated specimens being unannealed. This result indicates that silver plated on the nano-twinned copper layer diffuses into the nano-twinned copper layer after annealing to obtain a nano-twinned copper layer with doped silver having high strength.

Figure 5:
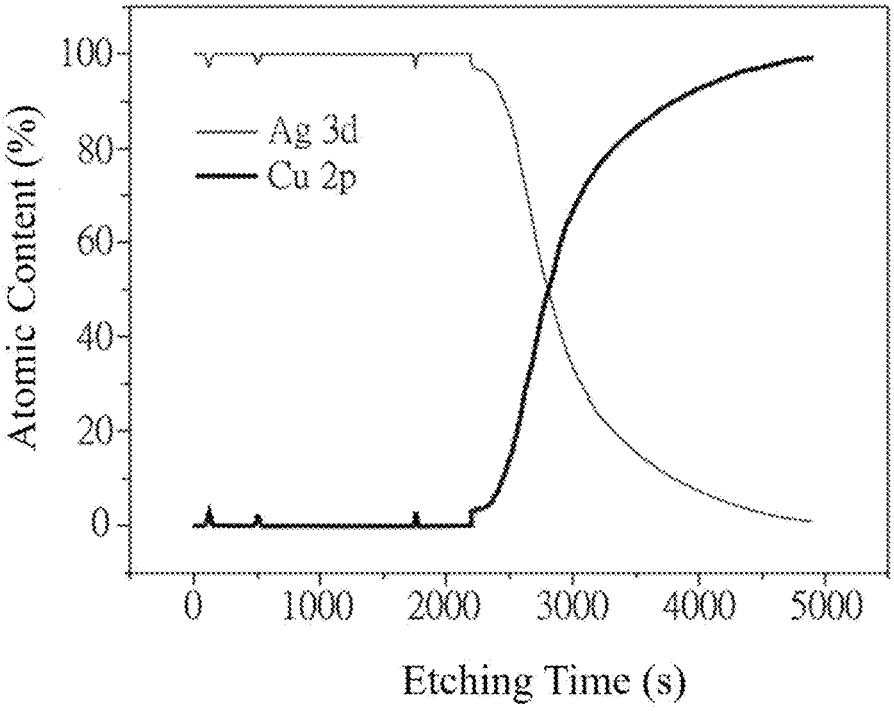
FIG. 5 is an X-ray photoelectron spectrum of the silver-plated nano-twinned copper layer after annealing according to Embodiment 1 of the present disclosure.
Figure 6:
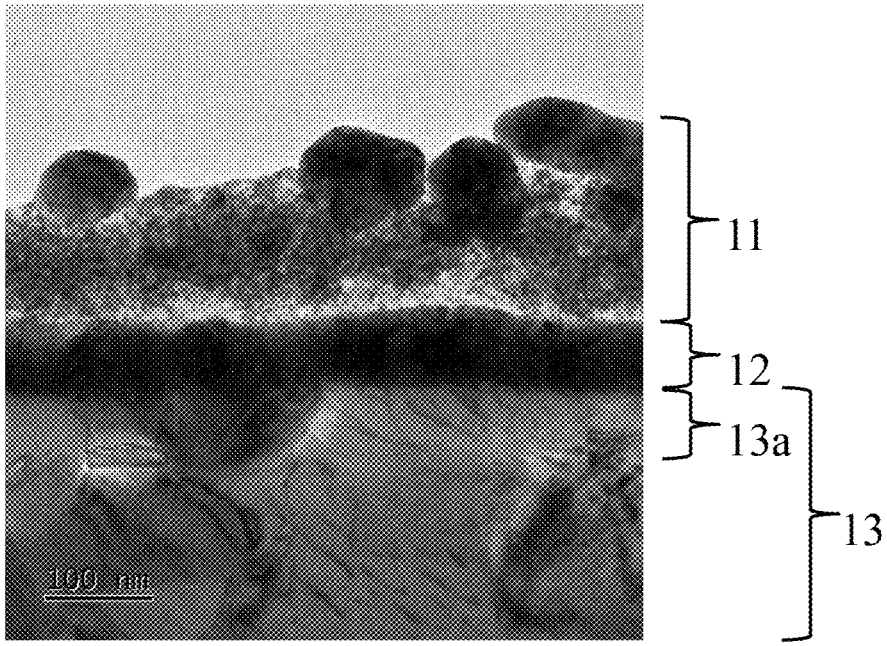
FIG. 6 is a TEM photo of the silver-plated nano-twinned copper layer after annealing according to Embodiment 1 of the present disclosure.

The silver-plated nano-twinned copper layer being performed with annealing at 100° C. for one hour of the present embodiment was analyzed by depth-profiling with X-ray photoelectron spectroscopy (XPS), the etch depth was set to 500 nm, and the interdiffusion of silver and copper was analyzed. The results are shown in FIG. 5. In addition, the silver-plated nano-twinned copper layer being annealed at 100° C. for one hour of the present embodiment was analyzed by transmission electron microscope (TEM). The results are shown in FIG. 6. In FIG. 6, a silver layer 12 is formed on the surface of the nano-twinned copper layer 13, a platinum layer 11 for TEM analysis is formed on the silver layer 12, and the nano-twinned copper layer 13 further comprises a diffusion layer 13*a*.

The diffusion of silver and copper can be found from the XPS diagram of FIG. 5, and it can be observed that the atomic concentration of silver decreases from the silver layer to the nano-twinned copper layer. In addition, it can be found from the TEM photo of FIG. 6 that the thickness of the diffusion layer 13*a* is ranged from about 100 nm to 150 nm, which represents that the silver diffuses in the area (i.e., the diffusion layer 13*a*) from the surface of the nano-twinned copper layer 13 to the depth of about 100 nm to150 nm, thereby doping the diffusion layer 13*a* with silver element. The foregoing results show that the diffusion of silver into the nano-twinned copper layer can increase the hardness of the nano-twinned copper layer; and the solid solution strengthening of silver and copper can enhance the hardness of the nano-twinned copper layer.

Generally, the lattice of the copper element in the nano-twinned copper layer is arranged in a regular manner to obtain an excellent lattice direction. Therefore, the nano-twinned copper layer itself has high strength, and it is difficult to enhance the strength. However, through the method provided in the present disclosure, the nano-twinned copper layer doped with silver can be obtained by performing annealing right after a simple cleaning. The hardness of the nano-twinned copper metal layer can be directly enhanced without additional work of hardening. In particular, the method provided in the present disclosure enhances the hardness of the nano-twinned copper layer by annealing at low temperature (50° C. to 250° C.) in a short period of time. Compared with annealing at high-temperature (for example, 400° C.), the preparation process of the present disclosure is simple and in favor of industrial production. Since the preparation method of the present disclosure dose not perform annealing at high temperature, the problem of decreasing the strength of the copper layer, due to the disappearance or reduction of the twinned structure after annealing, will not happen.

In the aforementioned embodiments of the present disclosure, the nano-twinned copper layer has a preferred (111) surface with high degree of regularity, which is the closet packing surface of a face centered cubic (FCC), so that the silver diffuses into the nano-twinned copper layer rapidly. In addition, silver is a metal with high-conductivity, and it is the substance with the highest electrical and thermal conductivity among all metals. As shown in FIG. 1 to FIG. 6, the the silver-copper alloy does not have eutectoid reactions, so it can reduce the occurrence of electromigration effect without having impacts on the electrical properties, thereby improving the reliability of the device. In addition, results of the hardness test show that the hardness of the silver-plated compared with the non-silver-plated nano-twinned copper layers can be increased by 27% after annealing. Therefore, the obtained nano-twinned copper layer with doped silver has an improved hardness and mechanical strength, thereby becoming a conductor with high strength, high electrical conductivity and high thermal conductivity, and it has potential for being applied to various electronic components.

Embodiment 2

The nano-twinned copper layer and the method for manufacturing the same, the annealing conditions and the hardness test method of the present embodiment are all the same as those in Embodiment 1, except that the silver film is replaced by a platinum film. Herein, the thickness of the platinum film was 100 nm, the deposition temperature was 100° C., the rate was 1 Å/S, and the time was 25 minutes. The hardness of the non-platinum-plated specimens and the platinum-plated specimens obtained before annealing or after annealing at various temperatures for 1 hr are shown in Table 2 below.

TABLE 2

| | Average hardness of the non-platinum-plated specimens (HV) | Average hardness of the platinum-plated specimens (HV) | Percentage of enhanced hardness (%) |
|---|---|---|---|
| Before annealing | 229.8 ± 6.3 (n = 5) | 301.6 ± 8.5 (n = 5) | 31.2% |
| Annealing at 50° C. for 1 hr | 229.4 ± 4.5 (n = 5) | 301.4 ± 5.4 (n = 5) | 31.3% |
| Annealing at 100° C. for 1 hr | 248.8 ± 3.9 (n = 5) | 316.8 ± 4.4 (n = 5) | 27.3% |
| Annealing at 150° C. for 1 hr | 214.8 ± 2.4 (n = 5) | 255.2 ± 3.9 (n = 5) | 18.8% |

As shown in Table 2, the hardness of the platinum-plated nano-twinned copper layer being annealed at 100° C. for one hour reaches 316.8 HV, which is higher than that of the non-platinum-plated specimens being unannealed by 37.9%.

Embodiment 3

The nano-twinned copper layer and the method for manufacturing the same, the annealing conditions and the hardness test method of the present embodiment are all the same as those in Embodiment 1, except that the silver film is replaced by an aluminum film. Herein, the thickness of the aluminum film was 100 nm, the deposition temperature was 75° C., the rate was 1 Å/S, and the time was 25 minutes. The hardness of the non-aluminum-plated specimens and the aluminum-plated specimens obtained before annealing or after annealing at various temperatures for 1 hr are shown in Table 3 below.

TABLE 3

| | Average hardness of the non-aluminum-plated specimens (HV) | Average hardness of the aluminum-plated specimens (HV) | Percentage of enhanced hardness (%) |
|---|---|---|---|
| Before annealing | 229.8 ± 6.3 (n = 5) | 247.2 ± 3.9 (n = 5) | 7.6% |
| Annealing at 50° C. for 1 hr | 229.4 ± 4.5 (n = 5) | 247.2 ± 3.9 (n = 5) | 7.8% |
| Annealing at 100° C. for 1 hr | 248.8 ± 3.9 (n = 5) | 303.6 ± 8.8 (n = 5) | 22.0% |
| Annealing at 150° C. for 1 hr | 214.8 ± 2.4 (n = 5) | 247.2 ± 3.9 (n = 5) | 15.1% |

As shown in Table 3, the hardness of the aluminum-plated nano-twinned copper layer being annealed at 100° C. for one hour reaches 303.6 HV, which is higher than that of the non-aluminum-plated specimens being unannealed by 32.1%.

Embodiment 4

The nano-twinned copper layer and the method for manufacturing the same, the annealing conditions and the hardness test method of the present embodiment are all the same as those in Embodiment 1, except that the silver film is replaced by a zinc film. Herein, the thickness of the zinc film was 100 nm, the deposition temperature was 75° C., the rate was 1 Å/S, and the time was 25 minutes. The hardness of the non-zinc-plated specimens and the zinc-plated specimens obtained before annealing or after annealing at various temperatures for 1 hr are shown in Table 4 below.

TABLE 4

| | Average hardness of the non-zinc-plated specimens (HV) | Average hardness of the zinc-plated specimens (HV) | Percentage of enhanced hardness (%) |
|---|---|---|---|
| Before annealing | 229.8 ± 6.3 (n = 5) | 260.2 ± 5.4 (n = 5) | 13.2% |
| Annealing at 50° C. for 1 hr | 229.4 ± 4.5 (n = 5) | 314.6 ± 5.4 (n = 5) | 37.1% |
| Annealing at 100° C. for 1 hr | 248.8 ± 3.9 (n = 5) | 314.6 ± 8.8 (n = 5) | 26.4% |
| Annealing at 150° C. for 1 hr | 214.8 ± 2.4 (n = 5) | 260.2 ± 5.4 (n = 5) | 21.1% |

As shown in Table 4 the hardness of the zinc-plated nano-twinned copper layer being annealed at 100° C. for one hour reaches 314.6 HV, which is higher than that of the non-zinc-plated specimens being unannealed by 36.9%.

Embodiment 5

The nano-twinned copper layer and the method for manufacturing the same, the annealing conditions and the hardness test method of the present embodiment are all the same as those in Embodiment 1, except that the silver film is replaced by a nickel film. Herein, the thickness of the nickel film was 100 nm, the deposition temperature was 75° C., the rate was 1 Å/S, and the time was 25 minutes. The hardness of the non-nickel-plated specimens and the nickel-plated specimens obtained before annealing or after annealing at various temperatures for 1 hr are shown in Table 5 below.

TABLE 5

| | Average hardness of the non-nickel-plated specimens (HV) | Average hardness of the nickel-plated specimens (HV) | Percentage of enhanced hardness (%) |
|---|---|---|---|
| Before annealing | 229.8 ± 6.3 (n = 5) | 293 ± 4.9 (n = 5) | 27.5% |
| Annealing at 50° C. for 1 hr | 229.4 ± 4.5 (n = 5) | 293.2 ± 8.4 (n = 5) | 27.8% |
| Annealing at 100° C. for 1 hr | 248.8 ± 3.9 (n = 5) | 299.6 ± 12.4 (n = 5) | 20.4% |
| Annealing at 150° C. for 1 hr | 214.8 ± 2.4 (n = 5) | 238.2 ± 5.6 (n = 5) | 10.9% |

As shown in Table 5, the hardness of the nickel-plated nano-twinned copper layer being annealed at 100° C. for one hour reaches 299.6 HV, which is higher than that of the non-zinc-plated specimens being unannealed by 30.4%.

For the non-metal-plated specimens being unannealed and the metal-plated specimens being annealed at 100° C. for one hour, the average hardness and the percentage of enhanced hardness are summarized in the following Table 6.

TABLE 6

| | Average hardness of the platinum-plated specimens (HV) | Average hardness of the aluminum-plated specimens (HV) | Average hardness of the silver-plated specimens (HV) | Average hardness of the zinc-plated specimens (HV) | Average hardness of the nickel-plated specimens (HV) |
|---|---|---|---|---|---|
| Non-metal-plated specimens being unannealed | 229.8 ± 6.3 (n = 5) | 229.8 ± 6.3 (n = 5) | 213.8 ± 8.5 (n = 5) | 229.8 ± 6.3 (n = 5) | 229.8 ± 6.3 (n = 5) |
| Metal-plated specimens being annealed | 316.8 ± 4.4 (n = 5) | 303.6 ± 8.8 (n = 5) | 270.8 ± 3.6 (n = 5) | 314.6 ± 8.8 (n = 5) | 299.6 ± 12.4 (n = 5) |
| Percentage of enhanced hardness (%) | 37.9% | 32.1% | 27% | 36.9% | 30.4% |

Embodiment 6

The nano-twinned copper layer and the method for manufacturing the same are similar to those in Embodiment 1, except for the following differences.

The plating solution used in the present embodiment comprises $CuSO_4.5H_2O$ (including 50 g/L of copper ion), 100 g of $H_2SO_4$, hydrochloric acid (containing 50 ppm of chloride ion), and additive (2 ml/L). Furthermore, the stirring rate was 510 rpm, the current density was 36 ASD, and the electroplating time was 378.79 seconds. Thereby, a nano-twinned copper layer with a thickness of about 20 μm can be obtained.

Figure 7:
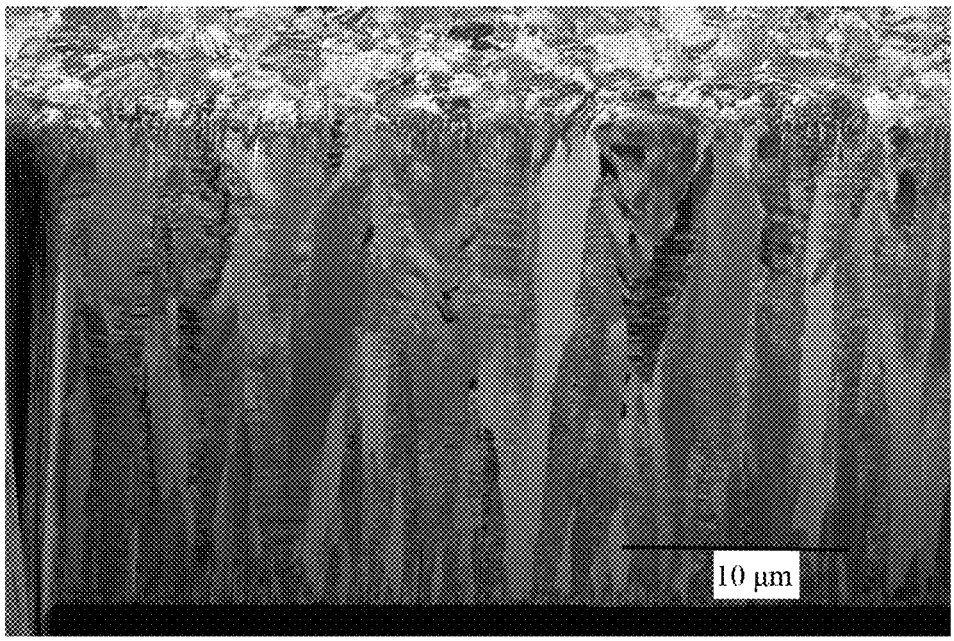
FIG. 7 is a FIB photo of a non-silver-plated nano-twinned copper layer before annealing according to Embodiment 6 of the present disclosure.

FIG. 7 is a FIB photo of a non-silver-plated nano-twinned copper layer before annealing according to the present embodiment. As shown in FIG. 7, most of the grains in the nano-twinned copper layer are twins with high density, the differences between such nano-twinned copper layer and the nano-twinned copper layer of Embodiment 1 are that the included angles between the twin direction (indicated by the arrow) of parts of the twinned grains and the thickness direction of the nano-twinned copper layer are about 10-20 degrees, and the included angles between the twin direction (indicated by the arrow) of parts of the twinned grains and the surface of the substrate are about 70-80 degrees; and, it represents the twinned grains is not vertical to the substrate.

Herein, a silver film was formed on the nano-twinned copper layer by the same method as in Embodiment 1, and tested under the same annealing conditions as in Embodiment 1. Furthermore, the hardness test method was the same as that of Embodiment 1. The results are shown in Table 7 below.

TABLE 7

| | Average hardness of the non-silver-plated specimens (HV) | Average hardness of the silver-plated specimens (HV) | Percentage of enhanced hardness (%) |
|---|---|---|---|
| Before annealing | 258.6 ± 6.3 (n = 5) | 255.2 ± 3.9 (n = 5) | −1% |
| Annealing at 50° C. for 1 hr | 267.2 ± 3.6 (n = 5) | 270.8 ± 6.7 (n = 5) | 1.3% |

TABLE 7-continued

| | Average hardness of the non-silver-plated specimens (HV) | Average hardness of the silver-plated specimens (HV) | Percentage of enhanced hardness (%) |
|---|---|---|---|
| Annealing at 100° C. for 1 hr | 274.4 ± 4.4 (n = 5) | 281.6 ± 4.4 (n = 5) | 2.6% |

As shown in Table 7, the hardness of the silver-plated nano-twinned copper layer being annealed at 100° C. for one hour reaches 281.6 HV, which is higher than that of the non-silver-plated specimens being unannealed by 8.9%.

Embodiment 7

The nano-twinned copper layer and the method for manufacturing the same, the annealing conditions and the hardness test method of the present embodiment are all the same as those in Embodiment 6, except that the silver film is replaced by a platinum film. Herein, the thickness and the preparation conditions of the platinum film are the same as those in Embodiment 2. The hardness of the non-platinum-plated specimens and the platinum-plated specimens obtained before annealing or after annealing at various temperatures for 1 hr are shown in Table 8 below.

TABLE 8

| | Average hardness of the non-platinum-plated specimens (HV) | Average hardness of the platinum-plated specimens (HV) | Percentage of enhanced hardness (%) |
|---|---|---|---|
| Before annealing | 258.6 ± 6.3 (n = 5) | 272.6 ± 4.4 (n = 5) | 5.4% |
| Annealing at 50° C. for 1 hr | 267.2 ± 3.6 (n = 5) | 293 ± 4.9 (n = 5) | 9.7% |
| Annealing at 100° C. for 1 hr | 274.4 ± 4.4 (n = 5) | 321.2 ± 8.2 (n = 5) | 17.1% |
| Annealing at 150° C. for 1 hr | 241.2 ± 3.4 (n = 5) | 279.8 ± 3.6 (n = 5) | 16.0% |

As shown in Table 8, the hardness of the platinum-plated nano-twinned copper layer being annealed at 100° C. for one hour reaches 321.2 HV, which is higher than that of the non-platinum-plated specimens being unannealed by 24.2%.

Embodiment 8

The nano-twinned copper layer and the method for manufacturing the same, the annealing conditions and the hardness test method of the present embodiment are all the same as those in Embodiment 6, except that the silver film is replaced by an aluminum film. Herein, the thickness and the preparation conditions of the aluminum film are the same as those in Embodiment 3. The hardness of the non-aluminum-plated specimens and the aluminum-plated specimens obtained before annealing or after annealing at various temperatures for 1 hr are shown in Table 9 below.

TABLE 9

| | Average hardness of the non-aluminum-plated specimens (HV) | Average hardness of the aluminum-plated specimens (HV) | Percentage of enhanced hardness (%) |
|---|---|---|---|
| Before annealing | 258.6 ± 6.3 (n = 5) | 255.2 ± 3.9 (n = 5) | −1% |
| Annealing at 100° C. for 1 hr | 274.4 ± 4.4 (n = 5) | 281.6 ± 4.4 (n = 5) | 2.6% |

As shown in Table 9, the hardness of the aluminum-plated nano-twinned copper layer being annealed at 100° C. for one hour reaches 281.6 HV, which is higher than that of the non-aluminum-plated specimens being unannealed by 8.9%.

For the non-metal-plated specimens being unannealed and the metal-plated specimens being annealed at 100° C. for one hour, the average hardness and the percentage of enhanced hardness are summarized in the following Table 10.

TABLE 10

| | Average hardness of the platinum-plated specimens (HV) | Average hardness of the aluminum-plated specimens (HV) | Average hardness of the silver-plated specimens (HV) |
|---|---|---|---|
| Non-metal-plated specimens being unannealed | 258.6 ± 6.3 (n = 5) | 258.6 ± 6.3 (n = 5) | 258.6 ± 6.3 (n = 5) |
| Metal-plated specimens being annealed | 321.2 ± 8.2 (n = 5) | 281.6 ± 4.4 (n = 5) | 281.6 ± 4.4 (n = 5) |
| Percentage of enhanced hardness (%) | 24.2% | 8.9% | 8.9% |

Embodiment 9

The nano-twinned copper layer and the method for manufacturing the same, the annealing conditions and the hardness test method of the present embodiment are all the same as those in Embodiment 1, except that the forward current density was set to 20 ASD (A/dm$^2$).

Figure 8:
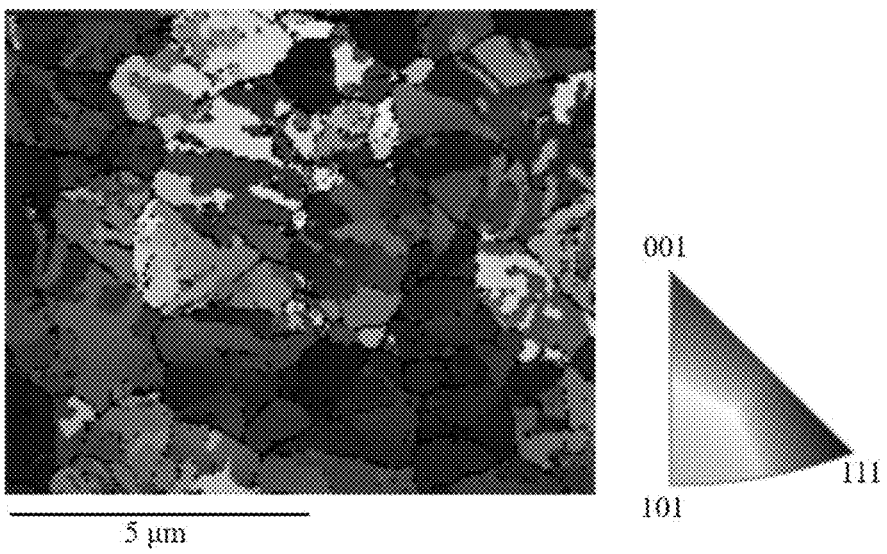
FIG. 8 is an EBSD photo of a non-silver-plated nano-twinned copper layer before annealing according to Embodiment 9 of the present disclosure.
Figure 9:
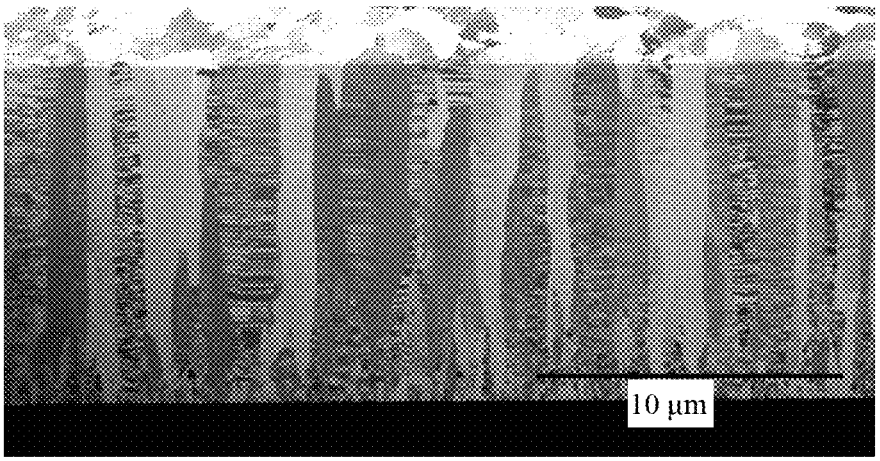
FIG. 9 is a FIB photo of a non-silver-plated nano-twinned copper layer before annealing according to Embodiment 9 of the present disclosure.

FIG. 8 is an EBSD photo of a non-silver-plated nano-twinned copper layer before annealing according to the present embodiment. FIG. 9 is a FIB photo of a non-silver-plated nano-twinned copper layer before annealing according to the present embodiment. The main difference between the nano-twinned copper layer of Embodiment 1 and that of the present embodiment is that 70% or more of the area of the surface of the nano-twinned copper layer expose the (111) surface of the nano twins.

The hardness of the non-silver-plated specimens and the silver-plated specimens obtained before annealing or after annealing at various temperatures for 1 hr are shown in Table 11 below.

TABLE 11

| | Average hardness of the non-silver-plated specimens (HV) | Average hardness of the silver-plated specimens (HV) | Percentage of enhanced hardness (%) |
|---|---|---|---|
| Before annealing | 253.6 ± 6 (n = 5) | 281.6 ± 4.4 (n = 5) | 11% |
| Annealing at 50° C. for 1 hr | 263.6 ± 4.4 (n = 5) | 291 ± 4.9 (n = 5) | 10.4% |
| Annealing at 100° C. for 1 hr | 270.8 ± 3.6 (n = 5) | 310.2 ± 4.4 (n = 5) | 14.5% |

As shown in Table 11, the hardness of the silver-plated nano-twinned copper layer being annealed at 100° C. for one hour reaches 310.2 HV, which is higher than that of the non-silver-plated specimens being unannealed by 22.3%.

Embodiment 10

The nano-twinned copper layer and the method for manufacturing the same, the annealing conditions and the hardness test method of the present embodiment are all the same as those in Embodiment 9, except that the silver film is replaced by a platinum film. Herein, the thickness and the preparation conditions of the platinum film are the same as those in Embodiment 2. The hardness of the non-platinum-plated specimens and the platinum-plated specimens obtained before annealing or after annealing at various temperatures for 1 hr are shown in Table 12 below.

TABLE 12

| | Average hardness of the non-platinum-plated specimens (HV) | Average hardness of the platinum-plated specimens (HV) | Percentage of enhanced hardness (%) |
|---|---|---|---|
| Before annealing | 253.6 ± 6 (n = 5) | 303.6 ± 5.4 (n = 5) | 19.7% |
| Annealing at 50° C. for 1 hr | 263.6 ± 4.4 (n = 5) | 301.4 ± 5.4 (n = 5) | 14.3% |
| Annealing at 100° C. for 1 hr | 270.8 ± 3.6 (n = 5) | 327.8 ± 4.4 (n = 5) | 21.1% |
| Annealing at 150° C. for 1 hr | 250.4 ± 3.2 (n = 5) | 265.4 ± 4.4 (n = 5) | 6.1% |

As shown in Table 12, the hardness of the platinum-plated nano-twinned copper layer being annealed at 100° C. for one hour reaches 327.8 HV, which is higher than that of the non-platinum-plated specimens being unannealed by 29.3%.

Embodiment 11

The nano-twinned copper layer and the method for manufacturing the same, the annealing conditions and the hardness test method of the present embodiment are all the same as those in Embodiment 9, except that the silver film is replaced by an aluminum film. Herein, the thickness and the preparation conditions of the aluminum film are the same as those in Embodiment 3. The hardness of the non-aluminum-plated specimens and the aluminum-plated specimens obtained before annealing or after annealing at various temperatures for 1 hr are shown in Table 13 below.

TABLE 13

| | Average hardness of the non-aluminum-plated specimens (HV) | Average hardness of the aluminum-plated specimens (HV) | Percentage of enhanced hardness (%) |
|---|---|---|---|
| Before annealing | 253.6 ± 6 (n = 5) | 253.6 ± 6 (n = 5) | 0% |
| Annealing at 50° C. for 1 hr | 263.6 ± 4.4 (n = 5) | 279.8 ± 6.7 (n = 5) | 6.1% |
| Annealing at 100° C. for 1 hr | 270.8 ± 3.6 (n = 5) | 301.4 ± 5.4 (n = 5) | 11.3% |
| Annealing at 150° C. for 1 hr | 250.4 ± 3.2 (n = 5) | 261.8 ± 3.6 (n = 5) | 4.6% |

As shown in Table 13, the hardness of the aluminum-plated nano-twinned copper layer being annealed at 100° C. for one hour reaches 301.4 HV, which is higher than that of the non-aluminum-plated specimens being unannealed by 18.8%.

Embodiment 12

The nano-twinned copper layer and the method for manufacturing the same, the annealing conditions and the hardness test method of the present embodiment are all the same as those in Embodiment 9, except that the silver film is replaced by a zinc film. Herein, the thickness and the preparation conditions of the zinc film are the same as those in Embodiment 4. The hardness of the non-zinc-plated specimens and the zinc-plated specimens obtained before annealing or after annealing at various temperatures for 1 hr are shown in Table 14 below.

TABLE 14

| | Average hardness of the non-zinc-plated specimens (HV) | Average hardness of the zinc-plated specimens (HV) | Percentage of enhanced hardness (%) |
|---|---|---|---|
| Before annealing | 253.6 ± 6 (n = 5) | 276.2 ± 8.8 (n = 5) | 8.9% |
| Annealing at 50° C. for 1 hr | 263.6 ± 4.4 (n = 5) | 314.6 ± 5.4 (n = 5) | 19.3% |

TABLE 14-continued

| | Average hardness of the non-zinc-plated specimens (HV) | Average hardness of the zinc-plated specimens (HV) | Percentage of enhanced hardness (%) |
|---|---|---|---|
| Annealing at 100° C. for 1 hr | 270.8 ± 3.6 (n = 5) | 312.4 ± 5.4 (n = 5) | 15.4% |
| Annealing at 150° C. for 1 hr | 250.4 ± 3.2 (n = 5) | 263.6 ± 4.4 (n = 5) | 5.3% |

As shown in Table 14, the hardness of the zinc-plated nano-twinned copper layer being annealed at 50° C. for one hour reaches 314.6 HV, which is higher than that of the non-zinc-plated specimens being unannealed by 18.8%.

Embodiment 13

The nano-twinned copper layer and the method for manufacturing the same, the annealing conditions and the hardness test method of the present embodiment are all the same as those in Embodiment 9, except that the silver film is replaced by a nickel film. Herein, the thickness and the preparation conditions of the nickel film are the same as those in Embodiment 5. The hardness of the non-nickel-plated specimens and the nickel-plated specimens obtained before annealing or after annealing at various temperatures for 1 hr are shown in Table 15 below.

TABLE 15

| | Average hardness of the non-nickel-plated specimens (HV) | Average hardness of the nickel-plated specimens (HV) | Percentage of enhanced hardness (%) |
|---|---|---|---|
| Before annealing | 253.6 ± 6 (n = 5) | 267.2 ± 3.6 (n = 5) | 5.4% |
| Annealing at 50° C. for 1 hr | 263.6 ± 4.4 (n = 5) | 293 ± 4.9 (n = 5) | 11.2% |
| Annealing at 100° C. for 1 hr | 270.8 ± 3.6 (n = 5) | 312.4 ± 5.4 (n = 5) | 15.3% |
| Annealing at 150° C. for 1 hr | 250.4 ± 3.2 (n = 5) | 281.6 ± 4.4 (n = 5) | 12.5% |

As shown in Table 15, the hardness of the nickel-plated nano-twinned copper layer being annealed at 100° C. for one hour reaches 312.4 HV, which is higher than that of the non-nickel-plated specimens being unannealed by 23.1%.

For the non-metal-plated specimens being unannealed and the metal-plated specimens being annealed at 100° C. for one hour, the average hardness and the percentage of enhanced hardness are summarized in the following Table 16.

TABLE 16

| | Average hardness of the platinum-plated specimens (HV) | Average hardness of the aluminum-plated specimens (HV) | Average hardness of the silver-plated specimens (HV) | Average hardness of the zinc-plated specimens (HV) | Average hardness of the nickel-plated specimens (HV) |
|---|---|---|---|---|---|
| Non-metal-plated specimens being unannealed | 253.6 ± 6 (n = 5) | 253.6 ± 6 (n = 5) | 253.6 ± 6 (n = 5) | 253.6 ± 6 (n = 5) | 253.6 ± 6 (n = 5) |
| Metal-plated specimens being annealed | 327.8 ± 4.4 (n = 5) | 301.4 ± 5.4 (n = 5) | 310.2 ± 4.4 (n = 5) | 312.4 ± 5.4 (n = 5) | 312.4 ± 5.4 (n = 5) |

TABLE 16-continued

| | Average hardness of the platinum-plated specimens (HV) | Average hardness of the aluminum-plated specimens (HV) | Average hardness of the silver-plated specimens (HV) | Average hardness of the zinc-plated specimens (HV) | Average hardness of the nickel-plated specimens (HV) |
|---|---|---|---|---|---|
| Percentage of entranced hardness (%) | 29.3% | 18.8% | 22.3% | 24.1% | 23.1% |

Embodiment 14

The nano-twinned copper layer and the method for manufacturing the same are similar to those in Embodiment 1, except for the following differences.

The plating solution used in the present embodiment comprises $CuSO_4.5H_2O$ (including 50 g/L of copper ion), 100 g of $H_2SO_4$, hydrochloric acid (containing 50 ppm of chloride ion), and additive (9 ml/L). Furthermore, the stirring rate was 1200 rpm, and the current density was 15 ASD. Thereby, a nano-twinned copper layer with a thickness of about 20 μm can be obtained.

Figure 10:
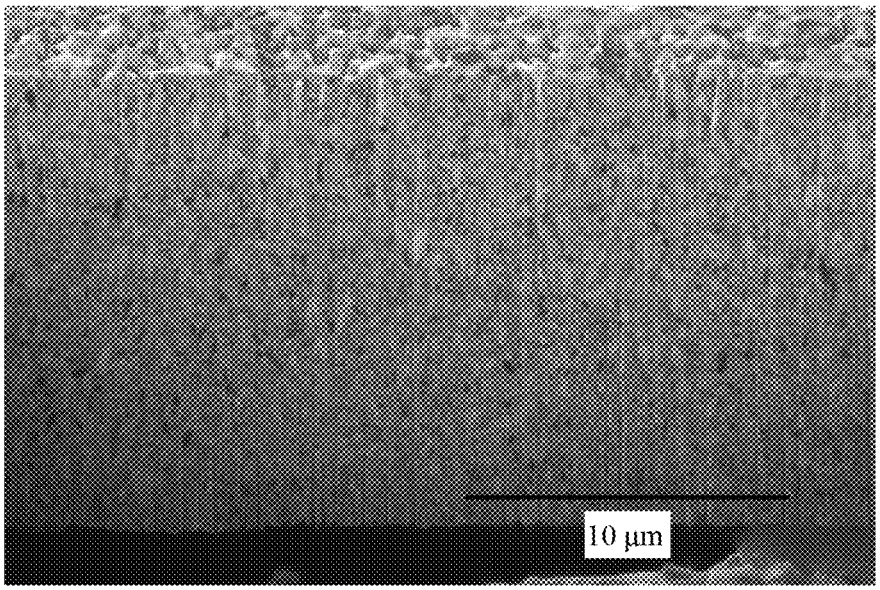
FIG. 10 is a FIB photo of a non-silver-plated nano-twinned copper layer before annealing according to Embodiment 14 of the present disclosure.

FIG. 10 is a FIB photo of a non-silver-plated nano-twinned copper layer before annealing according to the present embodiment. As shown in FIG. 10, the nano-twinned copper layer is formed by many fine twinned grains without a preferred direction, and the diameter (i.e., grain size) of the fine twinned grains is ranged from about 100 nm to 500 nm.

Herein, a silver film was formed on the nano-twinned copper layer by the same method as in Embodiment 1, and tested under the same annealing conditions as in Embodiment 1. Furthermore, the hardness test method was the same as that of Embodiment 1. The results are shown in Table 17 below.

TABLE 17

| | Average hardness of the non-silver-plated specimens (HV) | Average hardness of the silver-plated specimens (HV) | Percentage of enhanced hardness (%) |
|---|---|---|---|
| Before annealing | 239.8 ± 3.4 (n = 5) | 247.2 ± 3.9 (n = 5) | 3.1% |
| Annealing at 50° C. for 1 hr | 242.6 ± 2.8 (n = 5) | 248.8 ± 3.9 (n = 5) | 2.6% |
| Annealing at 100° C. for 1 hr | 265.4 ± 7.2 (n = 5) | 301.4 ± 5.4 (n = 5) | 13.6% |

As shown in Table 17, the hardness of the silver-plated nano-twinned copper layer being annealed at 100° C. for one hour reaches 301.4 HV, which is higher than that of the non-silver-plated specimens being unannealed by 25.7%.

As shown in Embodiments 1 to 14 above, whether it is a nano-twinned copper layer with a preferred direction formed by columnar twinned grains or a nano-twinned copper layer without a preferred direction formed by fine grains, the metal elements other than copper can diffuse into the nano-twinned copper layer through a process of plating a metal film other than a copper film on the nano-twinned copper and then annealing at the proper temperature, thereby significantly enhancing the hardness of the obtained nano-twinned copper layer with a doped metal element. Therefore, the nano-twinned copper layer with a doped metal element provided by the present disclosure retains the high electrical conductivity and high thermal conductivity of the nano-twinned copper layer. In particular, it has high strength and can be applied to various electronic components.

Although the present invention has been explained in relation to its preferred embodiment, it is to be understood that many other possible modifications and variations can be made without departing from the spirit and scope of the invention as hereinafter claimed.

What is claimed is:

1. A nano-twinned copper layer with a doped metal element, wherein the nano-twinned copper is doped with at least one metal element selected from the group consisting of Ag, Ni, Al, Au, Pt, Mg, Ti, Zn, Pd, Mn and Cd in a region from a surface of the nano-twinned copper layer to a depth being 0.3 μm, and a content of the metal element in the region is ranged from 0.5 at % to 20 at %; wherein at least 50% in volume of the nano-twinned copper layer comprises plural twinned grains, and a concentration of the metal element gradually decreases from the surface to the depth of 0.3 μm in the region.

2. The nano-twinned copper layer of claim 1, wherein the metal element is Ag, Ni, Al, Pt, or Zn.

3. The nano-twinned copper layer of claim 1, wherein at least 50% of an area of the surface of the nano-twinned copper layer expose a (111) surface of the plural twinned grains.

4. The nano-twinned copper layer of claim 1, wherein a thickness of the nano-twinned copper layer is ranged from 0.1 μm to 500 μm.

5. The nano-twinned copper layer of claim 1, wherein diameters of the plural twinned grains are respectively ranged from 0.1 μm to 50 μm.

6. The nano-twinned copper layer of claim 1, wherein thicknesses of the plural twinned grains are respectively ranged from 0.1 μm to 500 μm.

7. The nano-twinned copper layer of claim 1, wherein a metal film is further formed on the surface of the nano-twinned copper layer, and the metal film comprises the metal element.

8. The nano-twinned copper layer of claim 7, wherein the metal film comprises Ag, Ni, Al, Pt, or Zn.

9. The nano-twinned copper layer of claim 1, wherein the plural twinned grains are connected with each other, and each of the plural twinned grains are formed by stacking plural nano-twinned grains along a [111] crystal axis.

10. A substrate having a nano-twinned copper layer, comprising:

a substrate; and a nano-twinned copper layer with a doped metal element disposed on the substrate or embedded into the substrate, wherein the nano-twinned copper is doped with at least one metal element selected from the group consisting of Ag, Ni, Al, Au, Pt, Mg, Ti, Zn, Pd, Mn and Cd in a region from a surface of the nano-twinned copper layer to a depth being 0.3 μm, and a content of the metal element in the region is ranged from 0.5 at % to 20 at %; wherein at least 50% in volume of the nano-twinned copper layer comprises plural twinned grains, and a concentration of the metal element gradually decreases from the surface to the depth of 0.3 μm in the region.

11. A method for preparing a nano-twinned copper layer with a doped metal element, comprising the following steps:

providing a nano-twinned copper layer, wherein 50% or more in volume of the nano-twinned copper layer comprises plural twinned grains;

forming a metal film on a surface of the nano-twinned copper layer, wherein the metal film comprises at least one metal element selected from the group consisting of Ag, Ni, Al, Au, Pt, Mg, Ti, Zn, Pd, Mn and Cd; and annealing the nano-twinned copper layer provided with the metal film at 50° C. to 250° C. to form a nano-twinned copper layer with a doped metal element, wherein the nano-twinned copper layer is doped with the metal element in a region from a surface of the nano-twinned copper layer to a depth being 0.3 μm, and a content of the metal element in the region is ranged from 0.5 at % to 20 at %.

12. The method of claim 11, wherein the metal element is Ag, Ni, Al, Pt, or Zn.

13. The method of claim 11, wherein at least 50% of an area of the surface of the nano-twinned copper layer expose a (111) surface of the plural twinned grains.

14. The method of claim 11, wherein a thickness of the nano-twinned copper layer is ranged from 0.1 μm to 500 μm.

15. The method of claim 11, wherein diameters of the plural twinned grains are respectively ranged from 0.1 μm to 50 μm.

16. The method of claim 11, wherein thicknesses of the plural twinned grains are respectively ranged from 0.1 μm to 500 μm.

17. The method of claim 11, wherein the metal film is formed on the nano-twinned copper layer by vapor-deposition or sputtering.

18. The method of claim 11, wherein a thickness of the metal film is ranged from 50 nm to 500 nm.

19. The method of claim 11, wherein a concentration of the metal element gradually decreases from the surface to the depth of 0.3 μm in the region from the surface of the nano-twinned copper layer to the depth being 0.3 μm.

* * * * *